US006103675A

United States Patent [19]

Pyka et al.

[11] Patent Number: 6,103,675

[45] Date of Patent: Aug. 15, 2000

[54] PHOSPHORIC ESTERS AS EXTREME PRESSURE ADDITIVES

[75] Inventors: Peter Pyka, Augsburg; Barbara Vollnhals, Gersthofen; Bernd Pomrehn, Rueckersdorf, all of Germany

[73] Assignee: Clariant GmbH, Frankfurt, Germany

[21] Appl. No.: 09/038,561

[22] Filed: Mar. 11, 1998

[30] Foreign Application Priority Data

Mar. 12, 1997 [DE] Germany ..... 197 10 160

[51] Int. Cl.[7] ..... C10M 141/10

[52] U.S. Cl. ..... 508/438; 508/429; 508/431; 508/435; 508/436

[58] Field of Search ..... 508/436, 438, 508/431, 435, 429

[56] References Cited

U.S. PATENT DOCUMENTS

| | | | |
|---|---|---|---|
| 2,285,853 | 6/1942 | Downing et al. . | |
| 2,285,854 | 6/1942 | Downing et al. . | |
| 2,391,631 | 12/1945 | Kingerley . | |
| 2,602,049 | 7/1952 | Smith et al. | 508/436 |
| 2,815,324 | 12/1957 | Zenftman | 508/436 |
| 3,203,895 | 8/1965 | Latos et al. | 508/436 |
| 3,310,489 | 3/1967 | Davis . | |
| 3,657,123 | 4/1972 | Stram . | |
| 3,788,988 | 1/1974 | Dubourg | 508/436 |
| 3,933,658 | 1/1976 | Beiswanger et al. . | |
| 3,979,308 | 9/1976 | Mead et al. | 508/436 |
| 4,693,839 | 9/1987 | Kuwamoto et al. . | |
| 4,752,416 | 6/1988 | Scharf et al. . | |
| 4,769,178 | 9/1988 | Kenmochi et al. . | |
| 5,354,484 | 10/1994 | Schwind et al. | 508/436 |
| 5,552,068 | 9/1996 | Griffith | 508/436 |
| 5,789,358 | 8/1998 | Berlowitz et al. | 508/436 |
| 5,801,130 | 9/1998 | Francisco et al. | 508/436 |

FOREIGN PATENT DOCUMENTS

| | | |
|---|---|---|
| 0 391 653 A2 | 10/1990 | European Pat. Off. . |
| 0 146 140 B1 | 4/1991 | European Pat. Off. . |
| 3406427 | 8/1985 | Germany . |
| 88/03144 | 5/1988 | WIPO . |

*Primary Examiner*—Jerry D. Johnson
*Attorney, Agent, or Firm*—Susan S. Jackson; Scott E. Hanf

[57] ABSTRACT

The invention relates to the use of mixtures of one or more phosphoric esters of the formula (I) with one or more amines of the formula (II) as extreme pressure additives in water-immiscible cooling lubricants (I)

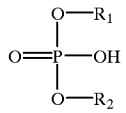

(II)

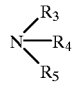

in which the substituents have the meaning defined in the description.

2 Claims, No Drawings

PHOSPHORIC ESTERS AS EXTREME PRESSURE ADDITIVES

Water-immiscible cooling lubricants are mineral oils or synthetic oils with or without added active ingredients. Cooling lubricants containing active ingredients are also referred to as "alloyed cooling lubricants".

Active ingredients contained in water-immiscible cooling lubricants are used, for example, for improving the lubricity, the wear behavior, the corrosion protection, the resistance to ageing and the foaming behavior. The type and amount of the additives used depend on the severity of the respective field of use. Water-immiscible cooling lubricants are distinguished in particular by good lubricity and good pressure absorption capacity. In the machining of metals, contact between solid workpiece and solid tool occurs in the area of mixed friction in practically all cases. The roughness peaks determine the frictional behavior and the wear of the friction counterparts present in the mixed friction area. Direct metallic contacts in these zones result in very high temperatures, which may lead to welding and to the tearing of particles out of the metal structure. As a result of the addition of EP additives (EP=extreme pressure) to the base lubricant, those parts of the surface of the friction counterparts which are in contact with one another and are thus heated owing to the friction change and form so-called chemical reaction layers which have mechanical properties which are more advantageous.

The group of EP additives includes chemical compounds which contain chlorine, phosphorus or sulfur as the active element, in addition to fatty substances (fatty acids or fatty esters). As a result of the high friction temperatures, metal soaps, metal chloride films, metal phosphite or metal phosphate films and metal sulfide films form on the metal surfaces and produce readily adhering, easily shearable reaction layers at the contact points. The reaction layers formed are effective as long as they are melted by the temperature increase due to frictional heat.

The reactivity of these additives is thus temperature-dependent, so that very specific temperature effect ranges can be assigned to the different additives. Fatty substances cover the lower temperature range. They form metal soaps or, owing to their asymmetrical molecular structure, are attracted by the metal surfaces and thus form adhering, semisolid films which increase the lubricity. Their reactivity extends up to about 200° C. Chlorine-containing additives are effective in a temperature range from about 180° C. to 620° C., and a temperature effect range from 240° C. to 900° C. is assigned to phosphorus-containing additives. Sulfur additives cover the upper temperature range from about 530° C. to over 1000° C.

The use of phosphoric esters as lubricant additives for the cold working of metals is known (EP-A-146 140). The use of acidic phosphoric esters as EP components is also described in the following patents: U.S. Pat. No. 2,391,631, U.S. Pat. No. 4,693,839, U.S. Pat. No. 2,285,853, U.S. Pat. No. 4,769,178, U.S. Pat. No. 4,752,416 and U.S. Pat. No. 2,285,854. EP-A-146140B1 describes the use of acidic phosphoric monoesters as components having lubricating activity. U.S. Pat. No. 3,657,123 describes amine salts of phosphoric esters, but also the use of acidic phosphoric esters as EP components in water-miscible lubricants. The use of oil-soluble salts of amines with weak acids as EP additives is also known (cf. EP-A-391653), inter alia phosphoric esters being mentioned here too. WO 88/03144 describes the use of oil-soluble metal salts of phosphoric esters as EP additives.

The group consisting of the chlorine-containing additives (the highly effective chloroparaffins are predominantly used here) is a widely used group of additives. Owing to ecological and toxicological reservations, the Oslo and Paris Commission has prohibited the use of short-chain chloroparaffins from 1999.

The EP additives known today are unsatisfactory in their action or, like the chloroparaffins, have considerable disadvantages in other respects.

It is therefore the object to provide novel EP additives which have the high effectiveness of the chloroparaffins but not the ecological and toxicological disadvantages.

It has now surprisingly been found that the use of amine-neutralized phosphoric monoester/diester mixtures in which two radicals different from another are present within a molecule of the diester, or the use of combinations of amine-neutralized phosphoric monoester/diester mixtures having different chain lengths and hence different decomposition temperatures, as EP additives in mineral oil, gives better results than a corresponding phosphoric ester amine salt alone. It can also be shown that cooling lubricants which contain such phosphoric ester mixtures as EP additives achieve a better cooling lubrication effect than those which contain substantially larger amounts of chlorine-containing additives, especially chloroparaffins.

The invention therefore relates to the use of mixtures of one or more phosphoric esters of the formula (I) with one or more amines of the formula (II)

(I)

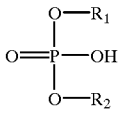

(II)

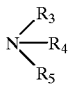

in which $R_1$ is a hydrogen atom or a $C_1$–$C_{20}$-alkyl group, preferably a $C_2$–$C_{13}$-alkyl group, a $C_2$–$C_{20}$-alkenyl group, preferably a $C_2$–$C_{13}$-alkenyl group, a $C_6$–$C_{10}$-aryl group optionally substituted by $C_1$–$C_5$-alkyl or by $C_1$–$C_5$-alkanol or an alkyl/arylpolyethylene glycol ether group having up to 18 carbon atoms, preferably having 12 to 18 carbon atoms, $R_2$ is a $C_1$–$C_{20}$-alkyl group preferably a $C_2$–$C_{13}$-alkyl group, a $C_2$–$C_{20}$-alkenyl group, preferably a $C_2$–$C_{13}$-alkenyl group, a $C_6$–$C_{10}$-aryl group optionally substituted by $C_1$–$C_5$-alkyl or by $C_1$–$C_5$-alkanol, or an alkyl/arylpolyethylene glycol ether group having up to 18 carbon atoms, preferably having 12 to 18 carbon atoms, $R_3$ to $R_5$, independently of one another, are a hydrogen atom, a $C_1$–$C_{20}$-alkyl group, preferably a $C_2$–$C_{13}$-alkyl group, a $C_2$–$C_{20}$-alkenyl group, preferably a $C_2$–$C_{13}$-alkenyl group, a $C_1$–$C_{20}$-hydroxyalkyl group, preferably a $C_2$–$C_{13}$-hydroxyalkyl group, a $C_2$ $C_{20}$-alkylamino group, preferably $C_2$–$C_{13}$-alkylamino group or a $C_6$–$C_{10}$-aryl group optionally substituted by $C_1$–$C_5$-alkyl or $C_1$–$C_5$-alkanol, and in which $R_1$ is not identical to $R_2$ at least in one phosphoric ester of the formula (I).

The mixtures used are either a combination of amine and a compound of the formula (I) having different radicals $R_1$ and $R_2$, or a combination of amine and a plurality of compounds of the formula (I), in which, if $R_1$ and $R_2$ are identical in a compound of the formula (I), then the radicals $R_1$ and $R_2$ must be different in another compound of the formula (I). In all cases, a total of two different radicals must be present in the phosphorus compounds.

Hydroxyalkyl groups are to be understood as meaning, for example, monoethanolamine, diethanolamine or triethanolamine, and the term amines also includes diamine. The amine used for the neutralization depends on the phosphoric esters used.

The mixtures in which $R_1$ is hydrogen or a butyl or ethylene glycol group and $R_2$ is a butyl or ethylene glycol group and in which $R_1$ is not identical to $R_2$ at least in one phosphoric ester of the formula (I) are also suitable.

Very particularly suitable are mixtures of two compounds of the formula (I) in which $R_1$ of one compound is hydrogen or an isotridecyl group and $R_2$ is an isotridecyl group and $R_1$ of the second compound is hydrogen, or a butyl or or an ethylene glycol group and $R_2$ is a butyl or ethylene glycol group, and in which $R_1$ is not identical to $R_2$ at least in one phosphoric ester of the formula (I).

The EP additive according to the invention has the following advantges:

very high effectiveness when used in low concentrations it is free of a chlorine.

For the neutralization of the phosphoric esters, the latter are taken and the corresponding amine slowly added with stirring. The resulting heat of neutralization is removed by cooling.

The EP additive according to the invention can be incorporated into the respective base liquid with the aid of fatty substances (e.g. tall oil fatty acid, oleic acid, etc.) as solubilizers. The base liquids used are napthenic or paraffinic base oils, synthetic oils (e.g. polyglycols, mixed polyglycols), polyolefins, carboxylic esters, etc.

EXAMPLE

The following products were used for the investigations:

| | |
|---|---|
| a) Phosphoric mono/diesters with butanol or glycol as esterification component | |
| Phosphorus content: | about 19.5% (m/m) |
| Acid number: | about 600 mg KOH/g |
| Decomposition temperature (DTA): | >95° C. |
| b) Phosphoric mono/diesters with isotridecyl alcohol as esterification component | |
| Phosphorus content: | about 8.5% (m/m) |
| Acid number: | about 230 mg KOH/g |
| Decomposition temperature (DTA): | >150° C. |
| c) Di-(2-ethylhexyl)amine | |
| pH (20° C.): | 9.5 |
| N content: | 5.81% |
| d) Chloroparaffin ® Hordaflex SP | |
| Chain length; | C14–C17 |
| Chlorine content: | about 56% (m/m) |
| Viscosity at 40° C.: | about 1200 $mm^2/s$ (DIN 51550 according to Ubbelohde with capillary viscometer) |
| e) Base formulation: (P = parts by weight) | |
| 1.5 P of phosphoric mono/diesters with butanol or glycol as esterification component | |
| 0.5 P of phosphoric mono/diesters with isotridecyl alcohol as esterification component | |
| 1.5 P of di-(2-ethylhexyl)amine | |
| Acid number: | about 330 mg KOH/g |
| Phosphorus content: | 9.57% |

Formulation 1: (Comparative experiment relating to the prior art)

14 P of phosphoric mono/diesters with isotridecyl alcohol as esterification componennt 6 P of di-(2-ethylhexyl)amine 20 P of fatty substance 60 P of naphthenic mineral oil Formulations 2 to 6 according to the invention:

Formulation 2:

9 P of phosphoric mono/diesters with butanol/glycol as esterification component

11 P of di-(2-ethylhexyl)amine

20 P of fatty substance

60 P of naphthenic mineral oil

Formulation 3:

5 P of base formulation

20 P of fatty substance

75 P of naphthenic mineral oil

Formulation 4:

10 P of base formulation

20 P of fatty substance

70 P of naphthenic mineral oil

Formulation 5:

20 P of base formulation

20 P of fatty substance

60 P of naphthenic mineral oil

Formulation 6:

30 P of base formulation

20 P of fatty substance

50 P of naphthenic mineral oil

Formulations 7 to 15 not according to the invention (chloroparaffins):

Formulation 7:

10 P of chloroparaffin

90 P of naphthenic mineral oil

Formulation 8:

20 P of chloroparaffin

80 P of naphthenic mineral oil

Formulation 9:

30 P of chloroparaffin

70 P of naphthenic mineral oil

Formulation 10:

40 P of chloroparaffin

60 P of naphthenic mineral oil

Formulation 11:

50 P of chloroparaffin

50 P of naphthenic mineral oil

Formulation 12:

60 P of chloroparaffin

40 P of naphthenic mineral oil

Formulation 13:

70 P of chloroparaffin

30 P of naphthenic mineral oil

Formulation 14:

80 P of chloroparaffin

20 P of naphthenic mineral oil

Formulation 15:

90 P of chloroparaffin

10 P of naphthenic mineral oil

Results of the tests according to DIN 51350 Part 2 in the Shell four-ball apparatus:

In this method, the lubricant is tested in a four-ball system. For this purpose, three balls (stationary balls) are firmly clamped in a ball pot. The fourth ball (moving ball) is held by a ball holder which rotates at a speed of 1420 $min^{-1}$. This speed corresponds to an average sliding speed of 0.542 m/s. The ball pot filled with lubricant is pressed against the fourth ball by means of a lever with a specific force. The four balls are thus arranged in the form of a pyramid, so that, at the three points of contact between the moving ball and the stationary balls, the Hertzian stress and hence the requirements with regard to the lubricant increase when the load is increased. The load at which the moving ball rotates for one minute without being welded to the stationary balls (=satisfactory load) and the load at which the four balls are welded together (welding load) are determined. The ball material used is the roller bearing steel 100 Cr 6 having a hardness of about 63 HRC.

The test results are shown in the table below:

| Formulation | Satisfactory/welding load [N] |
|---|---|
| 1 | 2200/2400 |
| 2 | 6500/7000 |
| 3 | 6000/6500 |
| 4 | 7000/7500 |
| 5 | 8500/9000 |
| 6 | 6500/7000 |
| 7 | 2600/2800 |
| 8 | 3000/3200 |
| 9 | 3400/3600 |
| 10 | 4400/4600 |
| 11 | 5000/5500 |
| 12 | 5500/6000 |
| 13 | 6500/7000 |
| 14 | 8000/8500 |
| 15 | 8500/9000 |

What is claimed is:

1. A method of using mixtures of two or more phosphoric esters of formula (I) with one or more amines of formula (II) comprising adding the mixtures as extreme pressure additives in water-immiscible cooling lubricants (I)

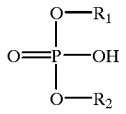

-continued (II)

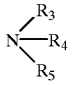

wherein $R_1$ of a first compound is a hydrogen atom or an isotridecyl group and $R_2$ is an isotridecyl group and $R_1$ of a second compound is a hydrogen atom, a butyl group or an ethylene glycol group and $R_2$ is a butyl group or an ethylene glycol group, and in which $R_1$ is not identical to $R_2$ at least in one phosphoric ester of the formula (I), and $R_3$ to $R_5$, independently of one another, are a hydrogen atom, a $C_1$–$C_{20}$-alkyl group, a $C_2$–$C_{20}$-alkenyl group, a $C_1$–$C_{20}$-hydroxyalkyl group, a $C_2$–$C_{20}$-akylamino group or a $C_6$–$C_{10}$-aryl group optionally substituted by $C_1$–$C_5$-alkyl or by $C_1$–$C_5$-alkanol.

2. The method of using as claimed in claim 1, wherein $R_3$ to $R_5$, independently of one another, are a hydrogen atom, a $C_2$–$C_{13}$-alkyl group, a $C_2$–$C_{13}$-alkenyl group, a $C_2$–$C_{13}$-hydroxyalkyl group, a $C_2$–$C_{13}$-alkylamino group or a $C_6$–$C_{10}$-aryl group optionally substituted by $C_1$–$C_5$-alkyl or $C_1$–$C_5$-alkanol.

* * * * *